US009687127B2

(12) United States Patent
Oka

(10) Patent No.: US 9,687,127 B2
(45) Date of Patent: Jun. 27, 2017

(54) SELF-PROPELLED VACUUM CLEANER

(71) Applicant: Sharp Kabushiki Kaisha, Osaka-shi, Osaka (JP)

(72) Inventor: Yasuhiro Oka, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 14/916,005

(22) PCT Filed: Jul. 22, 2014

(86) PCT No.: PCT/JP2014/069335
§ 371 (c)(1),
(2) Date: Mar. 2, 2016

(87) PCT Pub. No.: WO2015/075967
PCT Pub. Date: May 28, 2015

(65) Prior Publication Data

US 2016/0198913 A1 Jul. 14, 2016

(30) Foreign Application Priority Data

Nov. 25, 2013 (JP) ..... 2013-242950

(51) Int. Cl.
*A47L 5/22* (2006.01)
*A47L 9/14* (2006.01)
(Continued)

(52) U.S. Cl.
CPC ..... *A47L 5/22* (2013.01); *A47L 9/122* (2013.01); *A47L 9/1409* (2013.01); *A47L 9/28* (2013.01); *A47L 2201/00* (2013.01)

(58) Field of Classification Search
CPC ..... A47L 9/122; A47L 9/1409; A47L 9/28; A47L 2201/00
See application file for complete search history.

(56) References Cited

U.S. PATENT DOCUMENTS

2005/0015920 A1* 1/2005 Kim ..... A47L 9/1409 15/352
2007/0244610 A1* 10/2007 Ozick ..... A47L 5/30 701/23
(Continued)

FOREIGN PATENT DOCUMENTS

JP 2001-258807 A 9/2001
JP 2005-040597 A 2/2005
(Continued)

OTHER PUBLICATIONS

Official Communication issued in International Patent Application No. PCT/JP2014/069335, mailed on Oct. 21, 2014.

*Primary Examiner* — Dung Van Nguyen
(74) *Attorney, Agent, or Firm* — Keating & Bennett, LLP

(57) ABSTRACT

Provided is a self-propelled vacuum cleaner comprising: a housing that has an net formed on a lower surface and an exhaust port formed at one of left and right sides at a rear part and that can be self-propelled; and a dust-catching part provided between the inlet and the exhaust port through a ventilation path, wherein the dust-catching part includes a dust box disposed at the side of the net and an electrically powered fan disposed at the side of the exhaust port, the dust box and the electrically powered fan being configured to be separable.

3 Claims, 8 Drawing Sheets

(51) Int. Cl.
*A47L 9/12* (2006.01)
*A47L 9/28* (2006.01)

(56) References Cited

U.S. PATENT DOCUMENTS

2011/0239382 A1* 10/2011 Lee ..... A47L 9/009 15/3
2012/0084934 A1* 4/2012 Li ..... A47L 5/22 15/319

FOREIGN PATENT DOCUMENTS

JP 2006-149528 A 6/2006
JP 2008-136670 A 6/2008
JP 2012-075932 A 4/2012

* cited by examiner

SELF-PROPELLED VACUUM CLEANER

TECHNICAL FIELD

The present invention relates to a self-propelled vacuum cleaner.

BACKGROUND ART

As a self-propelled vacuum cleaner for cleaning dust on a floor surface, Patent Document 1 proposes a self-propelled vacuum cleaner including a housing that can be self-propelled and has a suction opening on its lower surface, a main brush mounted to the suction opening so as to be rotatable, and a side brush rotatably mounted anterior to the main brush on the lower surface of the housing.

The self-propelled vacuum cleaner described above includes a rechargeable battery incorporated in the housing and a start/stop switch provided on its top surface. A dust collection unit is detachably mounted at the rear part of the housing.

The dust collection unit includes a dust case having an inflow opening, an exhaust opening, a partition wall separating a space into an inflow side and an exhaust side, and a ventilation hole formed on a part of the partition wall; a filter provided to the ventilation hole; and an electric blower provided in the space of the dust case at the exhaust side.

A pair of positive and negative terminals electrically connected to the rechargeable battery through a lead line is provided at the rear part of the housing, and a pair of metal terminals electrically connected to the electric blower through a lead line is provided to the dust case of the dust collection unit. The positive and negative terminals and the pair of metal terminals are electrically connected to each other in the state in which the dust collection unit is attached to the rear part of the housing.

During driving of the self-propelled vacuum cleaner, dust on a floor surface is flown into the space in the dust case at the inflow side from the suction opening to be collected; and air passes through the filter, whereby the air from which dust is removed is exhausted to the outside from the exhaust opening through the electric blower.

To discard the dust collected in a dust collection space in the dust collection unit, a user removes the dust collection unit from the housing, and throws the dust inside into a dust bin with the inflow opening facing downward. In this case, the dust collection space can be cleaned by use of an accessory brush.

CITATION LIST

Patent Document

Patent Document 1: Japanese Unexamined Patent Publication No. 2012-75932

DISCLOSURE OF THE INVENTION

Problem to be Solved by the Invention

However, in the self-propelled vacuum cleaner described in Patent Document 1, the electric blower and a pair of metal terminals are provided in the dust collection unit, so that the dust case cannot be washed with water. Therefore, fine dust deposited on the dust case cannot completely be removed only with the brush, and it is impossible to sufficiently and perfectly clean the dust case. Since dust is likely to be deposited on the pair of metal terminals as well, there is concern that contact failure between the respective metal terminals and the positive and negative terminals at the housing occurs.

In addition, the self-propelled vacuum cleaner in Patent Document 1 has the structure in which, when the dust case is removed from the housing on a floor surface, the dust in the dust case is likely to be scattered on the floor surface from the inflow opening. This might cause the cleaned floor surface dirty.

The present invention is accomplished in view of the above circumstances, and aims to provide a self-propelled vacuum cleaner provided with a dust-catching part that can be washed with water and is difficult to cause electrical failure.

Means for Solving the Problem

Accordingly, the present invention provides a self-propelled vacuum cleaner comprising: a self-propellable housing having a inlet disposed on a lower surface and an exhaust port disposed at one of left and right sides at a rear part; and a dust-catching part disposed between the inlet and the exhaust port through a ventilation path, wherein the dust-catching part includes a dust box disposed at the inlet side and an electrically powered fan disposed at the exhaust-port side, and the dust box and the electrically powered fan being configured so as to be separable.

Effect of the Invention

In the self-propelled vacuum cleaner according to the present invention, the dust box and the electrically powered fan in the dust-catching part is configured to be separable. With this, after the dust box is removed from the housing and dust inside is thrown out, the dust box can be washed with water to completely remove fine dust. That is, the dust box can sufficiently be cleaned.

In the configuration in which metal terminals at the dust box are connected to or separated from positive and negative terminals at the housing as in the conventional case, dust is likely to be deposited on each terminal, and therefore, there is concern that contact failure between the metal terminals and the positive and negative terminals might occur. However, in the present invention, the configuration for electrically connecting the electrically powered fan to a battery through a lead line can be provided in the housing, whereby the above concern can be resolved.

In addition, since the exhaust port is provided at one of left and right sides at a rear part of the housing, and the electrically powered fan is disposed at the exhaust-port side, the dust box is disposed at the side opposite to the electrically powered fan. Therefore, the length of an intake channel from the inlet to the electrically powered fan can be increased, compared to the configuration in which the electrically powered fan is disposed at the middle position in the horizontal direction. Consequently, air is easy to be taken in through the entire filter provided in the dust box. This makes it difficult to cause clogging of the filter and is advantageous to reduce a load on the electrically powered fan.

MODE FOR CARRYING OUT THE INVENTION

First Embodiment

Overall Configuration of Self-Propelled Vacuum Cleaner

Figure 1:
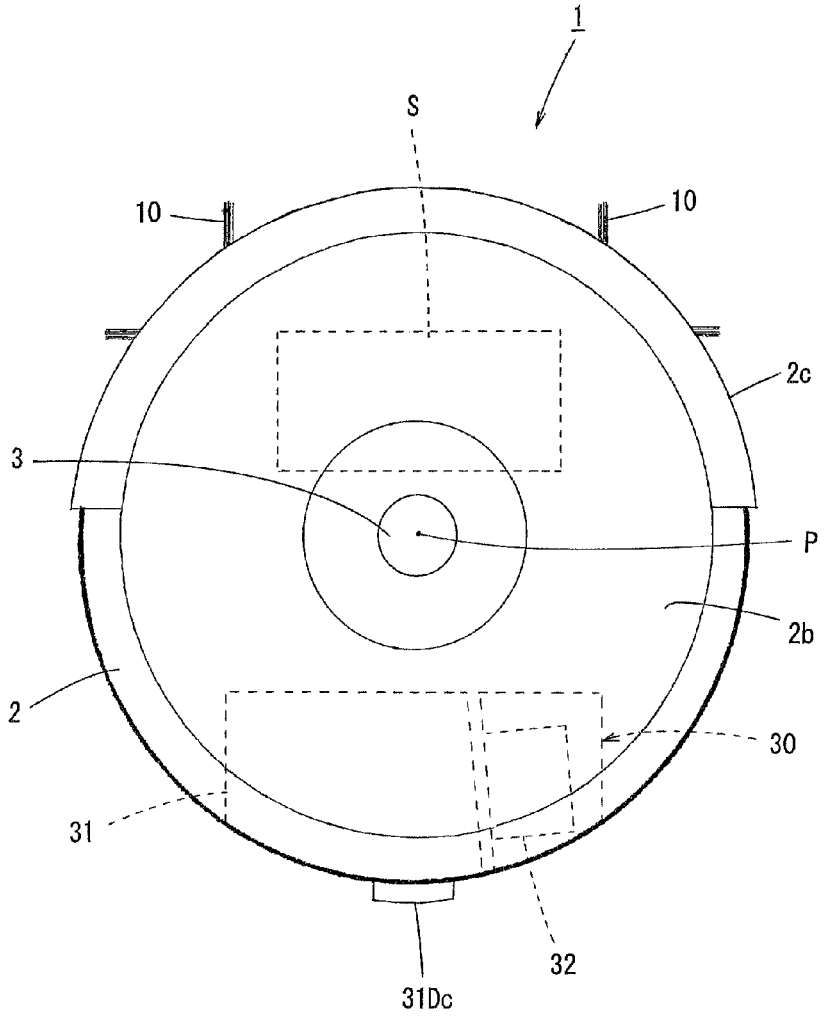
FIG. 1 is a plan view illustrating a self-propelled vacuum cleaner according to a first embodiment of the present invention.
Figure 2:
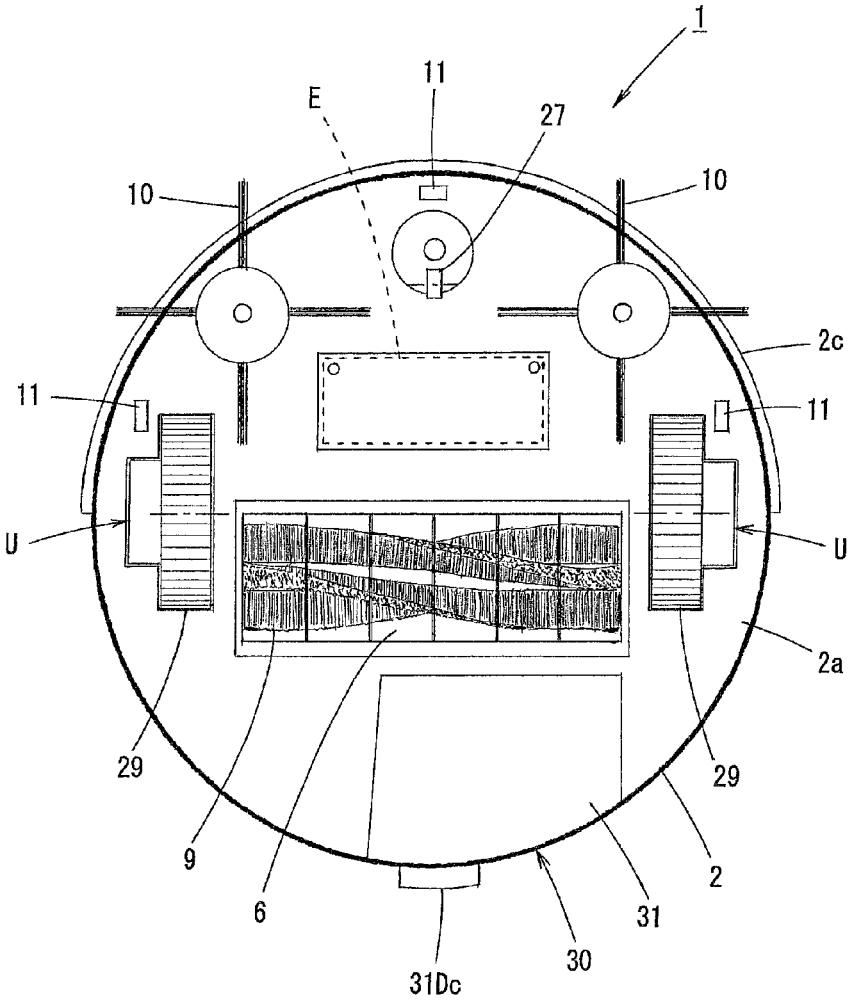
FIG. 2 is a bottom view of the self-propelled vacuum cleaner according to the first embodiment.
Figure 3:
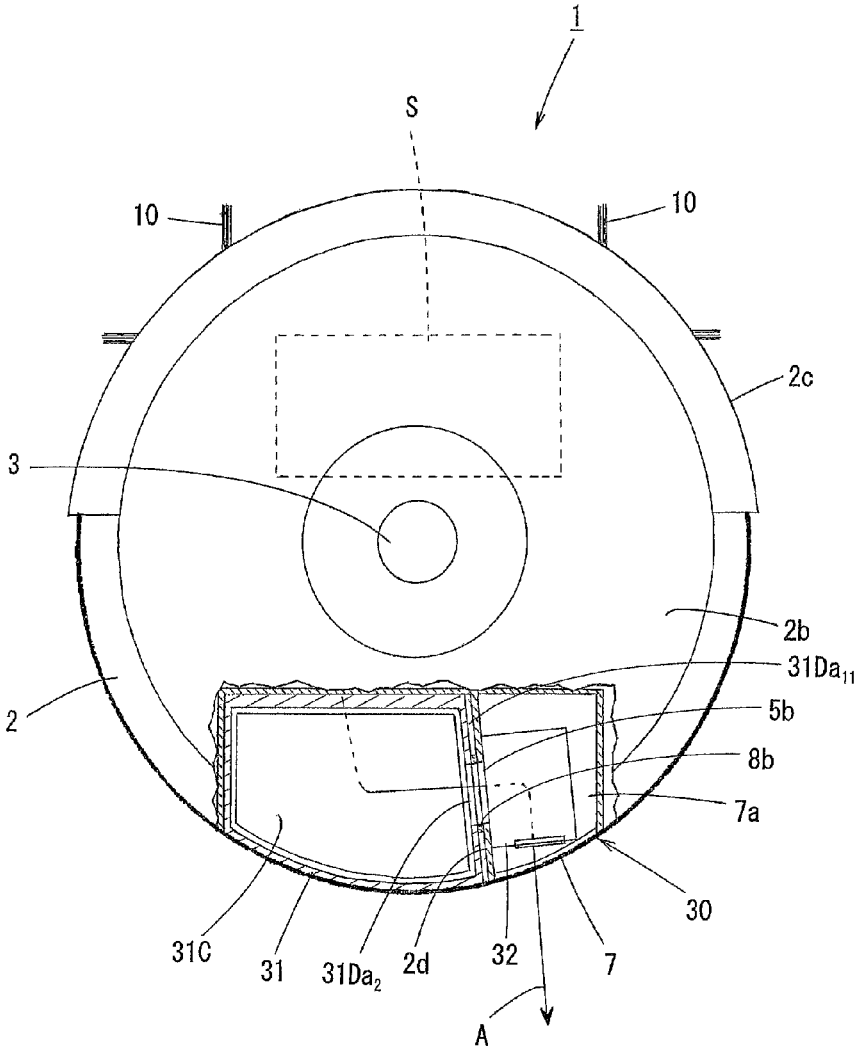
FIG. 3 is a partially cutout plan view for describing an internal structure of a dust-catching part in the self-propelled vacuum cleaner according to the first embodiment.
Figure 5:
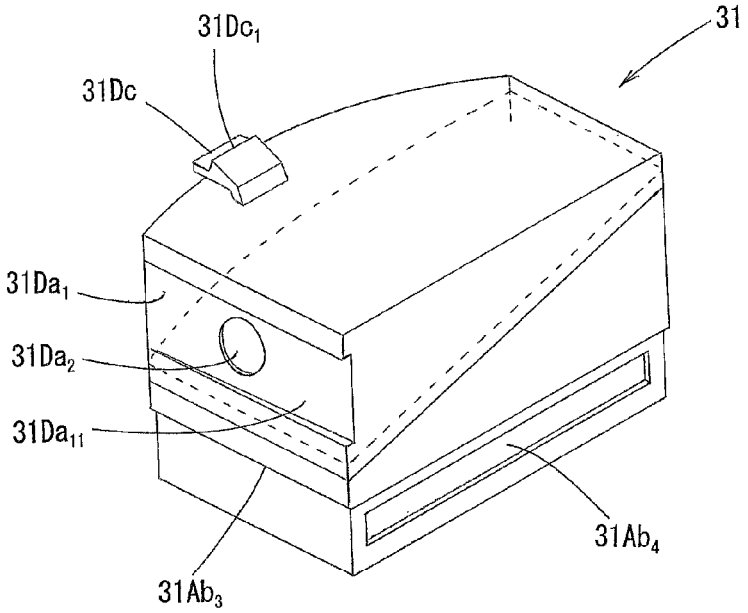
FIG. 5 is a perspective view of the dust box in the self-propelled vacuum cleaner according to the first embodiment.
Figure 6:
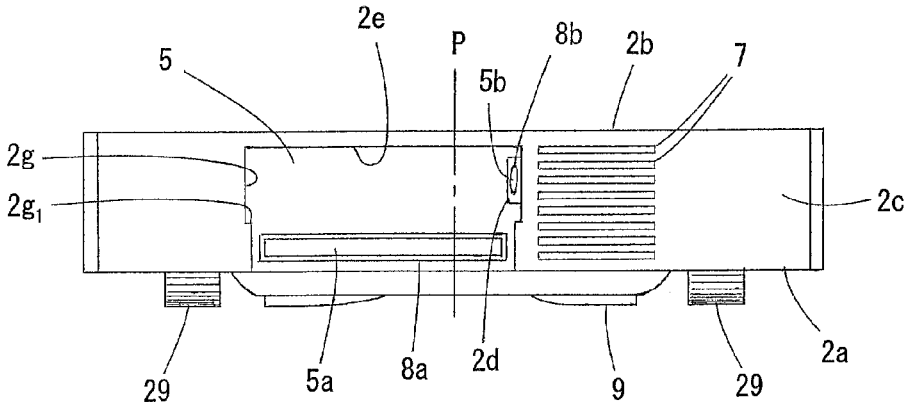
FIG. 6 is a back view of the self-propelled vacuum cleaner in the state in which the dust box is removed according to the first embodiment.
Figure 7:
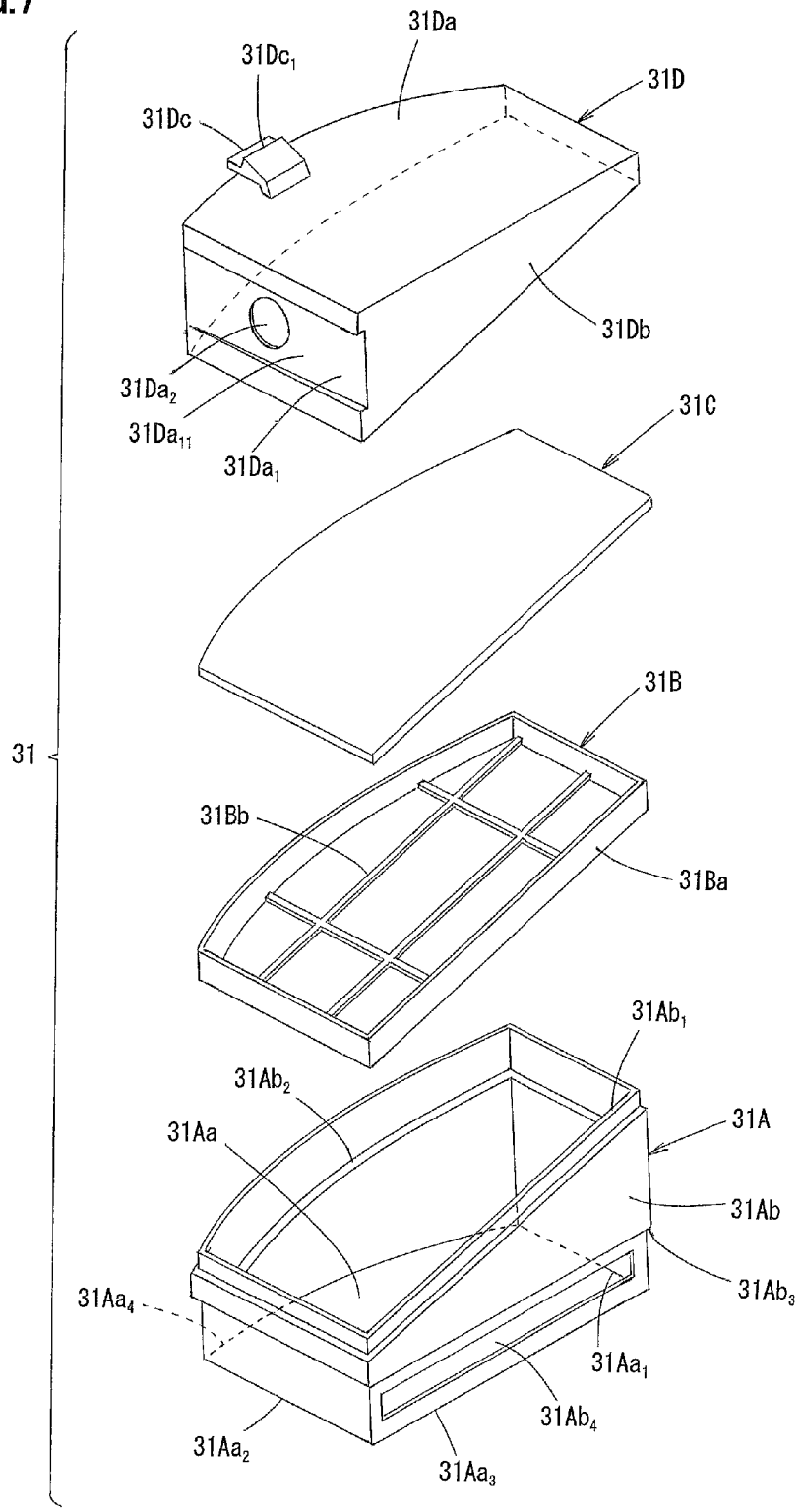
FIG. 7 is an exploded view of the dust box in the self-propelled vacuum cleaner according to the first embodiment.

FIG. 1 is a plan view illustrating a self-propelled vacuum cleaner according to a first embodiment of the present invention, FIG. 2 is a bottom view of the self-propelled vacuum cleaner according to the first embodiment, and FIG. 3 is a partially cutout plan view for describing an internal structure of a dust-catching part in the self-propelled vacuum cleaner according to the first embodiment. FIG. 4 is a side sectional view illustrating a dust-catching part in the self-propelled vacuum cleaner according to the first embodiment, wherein (A) illustrates a state in which a dust box is mounted, and (B) illustrates a state in which the dust box is removed. FIG. 5 is a perspective view of the dust box in the self-propelled vacuum cleaner according to the first embodiment, FIG. 6 is a back view of the self-propelled vacuum cleaner in the state in which the dust box is removed according to the first embodiment, and FIG. 7 is an exploded view of the dust box in the self-propelled vacuum cleaner according to the first embodiment.

As illustrated in FIGS. 1 to 7, a self-propelled electronic device according to the first embodiment of the present invention is a self-propelled vacuum cleaner 1 that sucks air including dust on a floor surface in a region where the cleaner is placed, while autonomously traveling on the floor surface, and exhausts air from which the dust is removed to thereby clean the floor surface.

The self-propelled vacuum cleaner 1 has a disc-like housing 2 provided with a inlet 6 on its lower surface and storing inside a battery E serving as a power source. Components, such as a rotary brush 9, side brushes 10, a dust-catching part 30 including a dust box 31 and an electrically powered fan 32, a pair of drive wheel units U each including a drive wheel 29, a turnable front wheel 27, various sensors including a floor surface detection sensor 11, and a control board S electrically connected to various sensors, are provided inside and outside of the housing 2.

With the self-propelled vacuum cleaner 1, the weight of the self-propelled vacuum cleaner 1 is distributed in front-back direction with respect to the housing 2 in order that the weight can be supported by a pair of drive wheels 29, which is mounted to the housing 2 at the middle position in the front-back direction, and the front wheel 27.

The housing 2 having a perpendicular center axis P at its center has a bottom plate 2*a* that is approximately circular in a plan view and has a inlet 6 formed at the position backward from the middle position in the front-back direction, a top plate 2*b* having a start/stop button 3 on a central position, and a side plate 2*c* that is annular in a plan view and formed along outer peripheries of the bottom plate 2*a* and the top plate 2*b*. The bottom plate 2*a* is provided with a plurality of holes from which a pair of drive wheels 29 projects to the outside from the housing 2, and an exhaust port 7 is formed at one of a left side and a right side at the rear part of the side plate 2*c*. In the first embodiment, the exhaust port 7 is formed at the right side with respect to the center axis P as viewed from back (see FIG. 6). Notably, the side plate 2*c* is split into two which are a front part and a rear part, and the front part of the side plate functions as a bumper.

The inlet 6 is a recessed open surface formed on the bottom surface (lower surface of the bottom plate 2*a*) of the housing 2 so as to face a floor surface K. The rotary brush 9 rotating about a shaft center parallel to the bottom surface of the housing 2 is provided in the inlet 6. Side brushes 10 rotating about a perpendicular rotation shaft center are provided at both of left and right sides of the inlet 6. The rotary brush 9 is formed such that brushes are helically implanted on an outer peripheral surface of a roller serving as the rotation shaft. Each of the side brushes 10 is formed such that a brush bundle is radially provided at a lower end of the rotation shaft. The rotation shaft of the rotary brush 9 and the rotation shafts of a pair of side brushes 10 are pivoted to a part of the bottom plate 2*a* of the housing 2, and coupled with a drive motor provided in the vicinity thereof through a power transmission mechanism including a pulley and a belt.

As illustrated in FIG. 2, floor surface detection sensors 11 are disposed in front of the front wheel 27 and at a front side at the side of left and right drive wheels 29 on the bottom surface of the housing 2. When the floor surface detection sensors 11 sense descending stairs, the sensing signals from the sensors 11 are transmitted to a control unit, and the control unit provided to the control board S controls to stop both drive wheels 29.

The control board S includes a control circuit that controls each of the components such as the drive wheels 29, the rotary brush 9, the side brushes 10, and the electrically powered fan 32 in the self-propelled vacuum cleaner 1.

The self-propelled vacuum cleaner 1 moves forward by forward rotations of the left and right drive wheels 29 in the same direction, moves backward by reverse rotations in the same direction, and turns with the rotations in the opposite direction. For example, the self-propelled vacuum cleaner 1 stops the drive wheels 29, and changes its direction by rotating the left and right drive wheels 29 in the opposite direction, in the case where the self-propelled vacuum cleaner 1 reaches an edge of an area to be cleaned and in the case where the self-propelled vacuum cleaner 1 collides against an obstacle on a traveling route. In this way, the self-propelled vacuum cleaner 1 autonomously travels, while avoiding obstacles throughout the entire region where the self-propelled vacuum cleaner 1 is placed or the entire desired range.

Dust-Catching Part

Figures 4A, 4B:
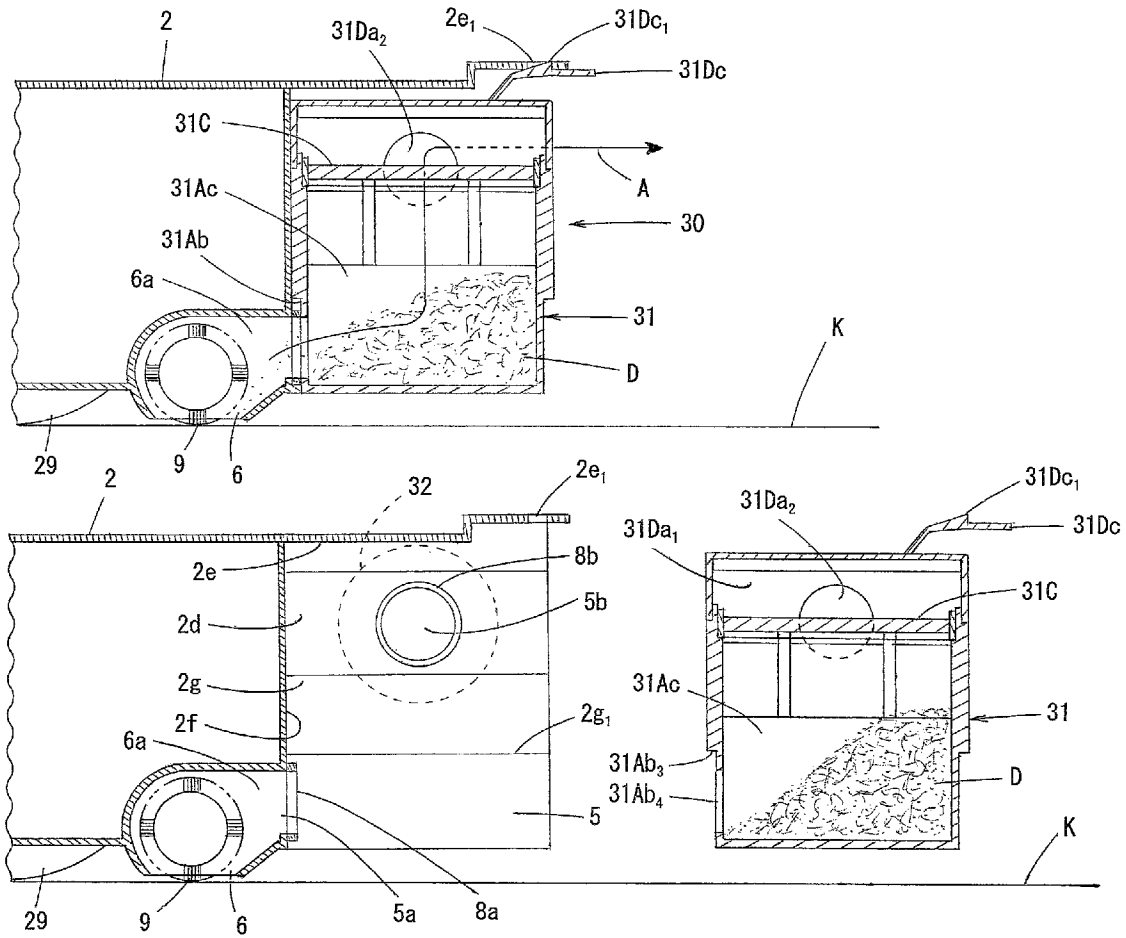
FIG. 4 is a side sectional view illustrating the dust-catching part in the self-propelled vacuum cleaner according to the first embodiment, wherein (A) illustrates a state in which a dust box is mounted, and (B) illustrates a state in which the dust box is removed.

As illustrated in FIG. 3 and FIG. 4(A), the dust-catching part 30 is provided between the inlet 6 and the exhaust port 7 through a ventilation path in the housing 2. It is to be noted that FIGS. 4(A) and (B) do not illustrate the structure anterior to the dust-catching part 30.

The dust-catching part 30 includes a dust box 31 disposed at the side of the inlet 6 and an electrically powered fan 32 disposed at the side of the exhaust port 7, the dust box 31 and the electrically powered fan 32 being configured to be separable. Specifically, the electrically powered fan 32 is disposed in the housing 2, and the dust box 31 is detachably disposed at the rear part of the housing 2.

The structure of the dust-catching part 30 and the ventilation path will be specifically described. Firstly, the housing 2 has a rear opening 5 formed by cutting the rear part of the side plate 2*c* from top to bottom. The rear opening 5 is an opening into which the dust box 31 is fitted, and is formed at a position shifted to a left side or right side with respect to the center axis P. In the first embodiment, the rear opening 5 is formed at the position shifted to the left side with respect to the center axis P as viewed from back. The detail of the rear opening 5 will be described later.

The housing 2 also includes an upstream ventilation path 6*a* which allows the inlet 6 and the rear opening 5 to communicate with each other, a downstream ventilation path 7*a* which allows the exhaust port 7 and the rear opening 5 to communicate with each other, a first packing 8*a* provided around a first connection opening 5*a* of the upstream ventilation path 6*a* at the side of the rear opening 5, and a second packing 8*b* provided around a second connection opening 5*b* of the downstream ventilation path 7*a* at the side of the rear opening 5.

The first packing 8*a* is made of a rubber ring. For example, it is attached around the first connection opening 5*a* with bonding by way of an adhesive agent, or with fitting around an annular projection part formed around the first connection opening 5*a*.

The second packing 8*b* is also made of a rubber ring. For example, it is also attached around the second connection opening 5*b* by way of an adhesive agent, or with fitting around an annular projection part formed around the second connection opening 5*b*.

The electrically powered fan 32 is fixed in the downstream ventilation path 7*a* formed at the side (at the right side as viewed from back) of the rear opening 5 in the housing 2. An inlet opening of the electrically powered fan 32 is disposed close to the second connection opening 5*b*, and a discharge opening of the electrically powered fan 32 is disposed close to the exhaust port 7.

As illustrated in FIG. 7, the dust box 31 includes a lower case 31A, a filter case 31B, a filter 31C, and an upper case 31D, wherein the filter case 31B storing the filter 31C is sandwiched between the upper case 31D and the lower case 31A.

The lower case 31A is open at the top, and has a bottom wall 31Aa having a short side 31$Aa_1$ and a long side 31$Aa_2$, which are parallel to each other, and a straight side 31$Aa_3$ and an arc side 31$Aa_4$ connecting both ends of the short side and the long side; and a surrounding wall 31Ab stands along an outer peripheral edge of the bottom wall 31Aa. An upper edge 31$Ab_1$ of the surrounding wall 31Ab tilts downward from the short side 31$Aa_1$ to the long side 31$Aa_2$ of the bottom wall 31Aa.

An inner step part 31$Ab_2$ exposed at the top side is provided on the inner peripheral surface of the surrounding wall 31Ab so as to be parallel to the upper edge 31$Ab_1$, an outer step part 31$Ab_3$ (see FIG. 4(B)) exposed at the bottom side is provided on the outer peripheral surface of the surrounding wall 31Ab, and an inflow opening 31$Ab_4$ connectable to the first connection opening 5*a* through the first packing 8*a* is formed on the front surface of the surrounding wall 31Ab below the outer step part 31$Ab_3$.

The filter case 31B includes a frame part 31Ba that is supported by the inner step part 31$Ab_2$ in a tilting manner when the filter case 31B is stored in the lower case 31A, and a lattice part 31Bb provided in the frame part 31Ba to support the filter 31C.

The filter 31C is formed to have a size by which the filter 31C is tightly fitted into the frame part 31Ba of the filter case 31B. For example, an HEPA filter can be used for the filter 31C. Notably, the filter 31C may be integrally formed with the filter case 31B.

The upper case 31D is a lid covering an upper opening of the lower case 31A, and includes an upper wall 31Da, a surrounding wall 31Db, and an engagement member 31Dc provided at the rear part of the upper wall 31Da.

The vertically middle part of the surrounding wall 31Db corresponding to the long side is recessed from back to front so as to tilt in the horizontal direction, and a discharge opening 31$Da_2$ connectable to the second connection opening 5*b* through the second packing 8*b* is formed on a recessed tilt wall part 31$Da_1$. The outer surface of the tilt wall 31$Da_1$ defines an opposite tilt side surface 31$Da_{11}$ which faces a later-described tilt side surface 2*d* of the housing 2.

The engagement member 31Dc is an elastically deformable member projecting to bend rearward from the rear part of the upper wall 31Da. An engagement projection 31$Dc_1$ with a triangular cross-section is formed on its top surface.

In the dust box 31 thus configured, the filter 31C is disposed between the inflow opening 31$Ab_4$ and the discharge opening 31$Da_2$, and a dust-catching chamber 31Ac is formed between the inflow opening 31$Ab_4$ and the filter 31C.

The rear opening 5 is configured as described below in order to attach the dust box 31 to the rear opening 5 of the housing 2 without falling off.

The rear opening 5 has the tilt side surface 2*d*, which tilts in the horizontal direction toward a front side and is formed at one of left and right side walls 2*g* where the electrically powered fan 32 is provided. In the first embodiment, the tilt side surface 2*d* tilting in the left direction toward the front side is formed on the right side wall 2*g* as viewed from back. The upper and lower sides of the tilt side surface 2*d* at the side walls 2*g* are vertical planes.

The rear opening 5 also has an inner wall 2*f* where the first packing 8*a* is provided, and left and right side walls 2*g* at the left and right of the inner wall 2*f*. Left and right step parts 2$g_1$ supporting the outer step part 31$Ab_3$ of the dust box 31 are formed on the left and right side walls 2*g*. In addition, a space into which the engagement member 31Dc of the dust box 31 is stored is formed at the back of a ceiling wall 2*e* of the rear opening 5, and an engagement recess 2$e_1$ is formed on the ceiling part of the space, wherein the engagement projection 31$Dc_1$ of the engagement member 31Dc can be engaged with or disengaged from the engagement recess 2$e_1$.

When the dust box 31 removed from the housing 2 (see FIG. 4(B)) is attached to the rear opening 5, the left and right outer step parts 31$Ab_3$ of the dust box 31 slide on the left and right step parts 2$g_1$ of the rear opening 5. When the dust box 31 is pushed all the way into the rear opening 5, the front surface of the surrounding wall 31Ab of the dust box 31 is in close contact with the first packing 8*a* (see FIG. 4(A)).

Also in this case, the opposite tilt side surface 31$Da_{11}$ of the dust box 31 is in close contact with the second packing 8*b*, and the engagement projection 31$Dc_1$ rides over the end of the ceiling wall 2*e* of the housing 2 to be engaged with the engagement recess 2$e_1$ due to the elastic deformation of the engagement member 31Dc. With this, the dust box 31 is mounted into the rear opening 5 of the housing 2 without falling off.

In the self-propelled vacuum cleaner 1 to which the dust box 31 is mounted, the electrically powered fan 32, the drive wheels 29, the rotary brush 9, and the side brushes 10 are driven according to an instruction of a cleaning operation. With this, the self-propelled vacuum cleaner 1 sucks air containing dust on the floor surface K from the inlet 6 with the state in which the rotary brush 9, the side brushes 10, the drive wheels 29, and the front wheel 27 are in contact with the floor surface K, while the housing 2 autonomously travels within a predetermined range. In this case, dust on the floor surface K is swirled up with the rotation of the rotary brush 9, and guided to the inlet 6. Further, dust at the side of the inlet 6 is guided to the inlet 6 with the rotation of the side brushes 10.

As illustrated in FIG. 3 and FIG. 4(A), air containing dust D sucked into the housing 2 through the inlet 6 passes through the upstream ventilation path 6*a* in the housing 2 to flow into the dust-catching chamber 31Ac of the dust-catching part 30. Air flow A going into the dust-catching chamber 31Ac passes through the filter 31*c* and the electrically powered fan 32, and then, is discharged to the outside from the exhaust port 7 through the downstream ventilation path 7*a*. In this case, the dust D contained in the air flow A in the dust-catching chamber 31Ac is caught by the filter 31C, whereby the dust D is accumulated in the dust-catching chamber 31Ac.

Since the dust box 31 has the discharge opening 31$Da_2$ at a right upper part as viewed from back, the right end of the filter 31C as viewed from back has to be located below the discharge opening 31$Da_2$, but the left end may be located above the discharge opening 31$Da_2$. Therefore, the filter 31C is supported in the dust box 31 in a tilting manner, whereby the area of the filter 31C and the volume of the dust-catching chamber 31Ac are increased more than the case where the filter 31C is horizontally supported.

In addition, the electrically powered fan 32 in the dust-catching part 30 is provided at one of the left and right sides, whereby the intake channel from the inlet 6 to the electrically powered fan 32 can be increased. With this, air is easy to be uniformly taken in through the entire filter 31C provided in the dust box 31, and this makes it difficult to cause clogging of the filter.

To discard the dust D in the dust box 31, the user draws the dust box 31 backward, while releasing the engagement projection 31$Dc_1$ from the engagement recess 2$e_1$ by pressing the engagement member 31Dc. Then, the user removes the upper case 31D and the filter case 31B storing the filter 31C from the lower case 31A of the dust box 31, and throws away the dust D in the lower case 31A into a dust bin.

According to the self-propelled vacuum cleaner of the present invention, the electrically powered fan 32 in the dust-catching part 30 is separated from the dust box 31 in this case, whereby the dust box 31 can be washed with water. Notably, the filter 31C may be cleaned with a brush, and further be washed with water in this case.

Second Embodiment

Figure 8:
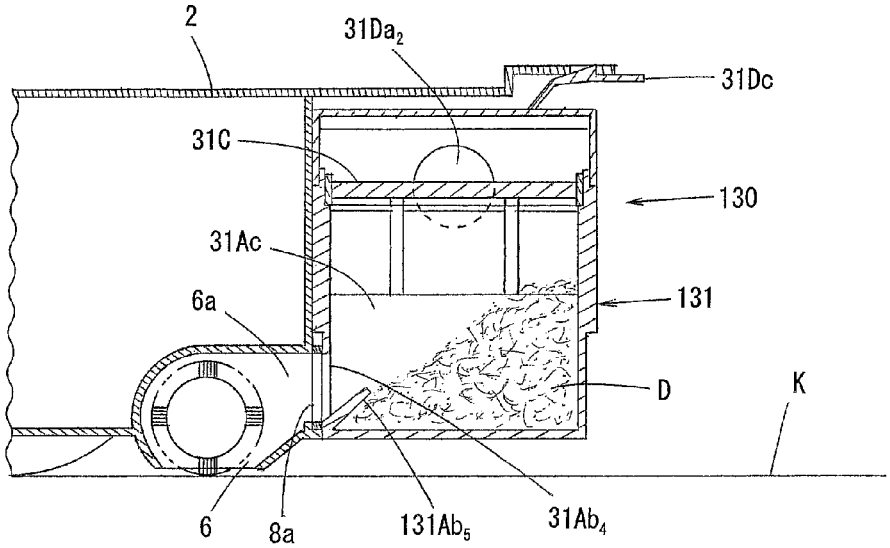
FIG. 8 is a side sectional view illustrating a dust-catching part in a self-propelled vacuum cleaner according to a second embodiment.

FIG. 8 is a side sectional view illustrating a dust-catching part of a self-propelled vacuum cleaner according to a second embodiment. In FIG. 8, the components same as those in FIGS. 1 to 7 are identified by the same reference numerals.

The self-propelled vacuum cleaner according to the second embodiment is similar to the first embodiment except for the configuration of a dust-catching part 130.

The second embodiment is different from the first embodiment in that a dust box 131 has a dust leak prevention member 131$Ab_5$ that is provided at the inflow opening 31$Ab_4$ for preventing the dust D in the dust-catching chamber 31Ac of the dust box 131 from leaking and falling from the inflow opening 31$Ab_4$. In the second embodiment, the dust leak prevention member 131$Ab_5$ projecting obliquely upward from the lower end of the inflow opening 31$Ab_4$ to the inner side is provided.

Since the dust leak prevention member 131$Ab_5$ is provided, the dust D accumulated in the dust-catching chamber 31Ac is difficult to leak and fall from the inflow opening 31$Ab_4$ to the outside when the dust box 131 is removed from the housing 2. Therefore, mistake of causing the cleaned room dirty with scattering dust D can be reduced.

Third Embodiment

Figure 9:
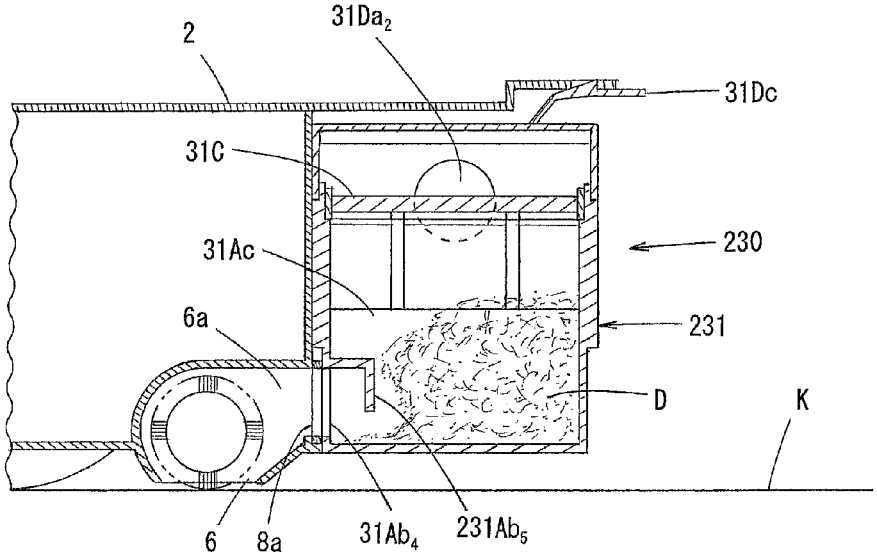
FIG. 9 is a side sectional view illustrating a dust-catching part in a self-propelled vacuum cleaner according to a third embodiment.

FIG. 9 is a side sectional view illustrating a dust-catching part of a self-propelled vacuum cleaner according to a third embodiment. In FIG. 9, the components same as those in FIG. 8 are identified by the same reference numerals.

The self-propelled vacuum cleaner according to the third embodiment is similar to the first and second embodiments except for the configuration of a dust-catching part 230.

In the third embodiment, a dust leak prevention member 231$Ab_5$ different from the dust leak prevention member 131$Ab_5$ in the second embodiment is provided to the inflow opening 31$Ab_4$. The dust leak prevention member 231$Ab_5$ horizontally projects from the upper end of the inflow opening 31$Ab_4$ toward the inner side, and extends downward to form an inverted L shape.

With the formation of the dust leak prevention member 231$Ab_5$ as well, leakage and falling of the dust D from the inflow opening 31$Ab_4$ upon removing the dust box 131 from the housing 2 can be prevented as in the second embodiment.

Fourth Embodiment

Figure 10:
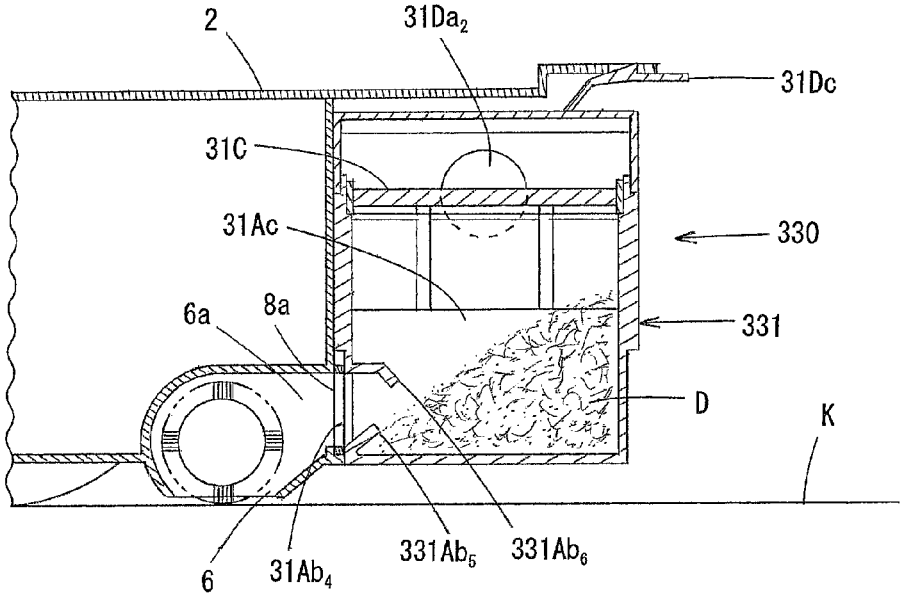
FIG. 10 is a side sectional view illustrating a dust-catching part in a self-propelled vacuum cleaner according to a fourth embodiment.

FIG. 10 is a side sectional view illustrating a dust-catching part of a self-propelled vacuum cleaner according to a fourth embodiment. In FIG. 10, the components same as those in FIG. 8 are identified by the same reference numerals.

The self-propelled vacuum cleaner according to the fourth embodiment is similar to the first to third embodiments except for the configuration of a dust-catching part 330.

In the fourth embodiment, a dust leak prevention member 331$Ab_5$ corresponding to the dust leak prevention member 131$Ab_5$ in the second embodiment is provided at the lower end of the inflow opening 31$Ab_4$, and a dust leak prevention member 331$Ab_6$ corresponding to the dust leak prevention member 231$Ab_5$ is provided at the upper end of the inflow opening 31$Ab_4$.

As in the second and third embodiments, the fourth embodiment can also prevent the dust D from leaking and falling from the inflow opening 31$Ab_4$ upon removing the dust box 331 from the housing 2.

Fifth Embodiment

In the self-propelled vacuum cleaner according to the present invention, the rotary brush 9 and the side brushes 10 described in the first embodiment are not required components, so that they may be eliminated.

SUMMARY

A self-propelled vacuum cleaner according to the present invention includes a self-propellable housing having a inlet disposed on a lower surface and an exhaust port disposed at one of left and right sides at a rear part; and a dust-catching part disposed between the inlet and the exhaust port through a ventilation path, wherein the dust-catching part includes a dust box disposed at the inlet side and an electrically powered fan disposed at the exhaust-port side, and the dust box and the electrically powered fan being configured so as to be separable.

The self-propelled vacuum cleaner according to the present invention may be configured as described below.

(1) In the dust-catching part, the electrically powered fan may be disposed in the housing, and the dust box may be detachably mounted to the rear part of the housing.

With this configuration, a battery that is a heavy load can be disposed at a front part of the housing, whereby the center of gravity can be placed on the front part of the housing. This results in supporting the housing with a pair of left and right drive wheels and a front wheel, whereby a rear wheel can be eliminated.

(2) The housing may include a rear opening into which the dust box is fitted, an upstream ventilation path that allows the inlet and the rear opening to communicate with each other, a downstream ventilation path that allows the exhaust port and the rear opening to communicate with each other, a first packing provided around a first connection opening of the upstream ventilation path at the rear-opening side, and a second packing provided around a second connection opening of the downstream ventilation path at the rear-opening side, the electrically powered fan may be disposed in the downstream ventilation path, the dust box may include an inflow opening connectable to the first connection opening through the first packing, a discharge opening connectable to the second connection opening through the second packing, a filter provided between the inflow opening and the discharge opening, and a dust-catching chamber provided between the inflow opening and the filter, and the filter may be supported in the dust box in a tilting manner such that an end of the filter at the discharge-opening side becomes lower than the discharge opening and the end opposite to the discharge opening becomes higher than the discharge opening.

With this configuration, the area of the filter and the volume of the dust-catching chamber can be increased. This results in advantageously suppressing clogging of the filter and reducing a load on the electrically powered fan.

(3) The housing may have a tilt side surface tilting in the horizontal direction toward a front side at the portion where the second packing is provided, and the dust box may have an opposite tilt side surface tilting in the horizontal direction toward a front side at the portion where the discharge opening is formed.

With this configuration, the surrounding of the discharge opening on the opposite tilt side surface of the dust box can easily be brought into close contact with the second packing upon mounting the dust box. In this case, with the configuration in which the tilt side surface is formed on the housing and the opposite tilt side surface is formed on the dust box, a problem of abrasion or falling of the second packing due to scrape of the other parts of the dust box with the second packing can be avoided.

(4) The dust box may have a dust fall prevention member provided at the inflow opening for preventing dust in the dust box from leaking and falling from the inflow opening.

With this configuration, dust in the dust box is difficult to leak and fall from the inflow opening onto a floor surface upon removing the dust box from the housing on the floor surface. This can prevent mistake of causing the cleaned floor surface dirty.

The embodiments of the present invention described above should be considered in all respects as illustrative and not restrictive of the present invention. The scope of the present invention is not limited to the above description, but the accompanying claims and their equivalents are intended to cover such forms or modifications as would fall within the scope and spirit of the invention.

EXPLANATION OF NUMERALS

2 Housing
2*d* Tilt side surface
5 Rear opening
5*a* First connection opening
5*b* Second connection opening
6 Inlet
6*a* Upstream ventilation path
7 Exhaust port
7*a* Downstream ventilation path
8*a* First packing
8*b* Second packing
30, 130, 230, 330 Dust-catching part
31, 131, 231, 331 Dust box
31$Ab_4$ Inflow opening
31Ac Dust-catching chamber
31C Filter
31$Da_{11}$ Opposite tilt side surface
31$Da_2$ Discharge opening
32 Electrically powered fan
131$Ab_5$, 231$Ab_5$, 331$Ab_5$, 331$Ab_6$ Dust fall prevention member

The invention claimed is:

1. A self-propelled vacuum cleaner comprising:

a self-propellable housing including an inlet on a lower surface and an exhaust port at one of a left side and a right side at a rear portion; and a dust-catching portion between the inlet and the exhaust port through a ventilation path, wherein the dust-catching portion includes a dust box at an inlet side and an electrically powered fan at an exhaust-port side, the dust box and the electrically powered fan are configured so as to be separable, the electrically powered fan is in the housing, and the dust box is detachably mounted to the rear portion of the housing in the dust-catching portion, the housing includes a rear opening into which the dust box is fitted, an upstream ventilation path that allows the inlet and the rear opening to communicate with each other, a downstream ventilation path that allows the exhaust port and the rear opening to communicate with each other, a first packing provided around a first connection opening of the upstream ventilation path at the rear-opening side, and a second packing provided around a second connection opening of the downstream ventilation path at the rear-opening side, the electrically powered fan is in the downstream ventilation path, the dust box includes an inflow opening connectable to the first connection opening through the first packing, a discharge opening connectable to the second connection opening through the second packing, a filter between the inflow opening and the discharge opening, and a dust-catching chamber between the inflow opening and the filter, and the filter is supported in the dust box in a tilting manner such that an end of the filter at the discharge-opening side becomes lower than the discharge opening and the end opposite to the discharge opening becomes higher than the discharge opening.

2. The self-propelled vacuum cleaner according to claim 1, wherein the housing includes a tilt side surface tilting in the horizontal direction toward a front side at the portion where the second packing is provided, and the dust box includes an opposite tilt side surface tilting in the horizontal direction toward a front side at the portion where the discharge opening is defined.

3. The self-propelled vacuum cleaner according to claim 1, wherein the dust box includes a dust fall prevention member provided at the inflow opening to prevent dust in the dust box from leaking and falling from the inflow opening.

* * * * *